United States Patent [19]

Kobayashi

[11] Patent Number: 4,754,974

[45] Date of Patent: Jul. 5, 1988

[54] GOLF CLUB HEAD

[75] Inventor: Masashi Kobayashi, Matsudo, Japan

[73] Assignee: Maruman Golf Co., Ltd., Tokyo, Japan

[21] Appl. No.: 8,887

[22] Filed: Jan. 30, 1987

[30] Foreign Application Priority Data

Jan. 31, 1986 [JP] Japan ..... 61-17719

[51] Int. Cl.[4] ..... A63B 53/04

[52] U.S. Cl. ..... 273/167 E; 273/164

[58] Field of Search ..... 273/167 E, 164, 167 A, 273/167 R, 169, 170, 171, 172

[56] References Cited

U.S. PATENT DOCUMENTS

| | | | |
|---|---|---|---|
| D. 192,515 | 4/1962 | Henrich | 273/167 E |
| 3,273,891 | 9/1966 | Grim | 273/DIG. 30 |
| 3,458,194 | 7/1969 | Coles | 273/DIG. 30 |
| 4,065,133 | 12/1977 | Gordos | 273/167 E |

FOREIGN PATENT DOCUMENTS

| | | | |
|---|---|---|---|
| 48-71958 | 9/1973 | Japan . | |
| 50-88047 | 7/1975 | Japan . | |
| 0000538 | 1/1977 | Japan | 273/167 E |
| 53-78167 | 6/1978 | Japan . | |
| 53-31417 | 9/1978 | Japan . | |
| 57-179483 | 11/1982 | Japan . | |

*Primary Examiner*—George J. Marlo

*Attorney, Agent, or Firm*—Armstrong, Nikaido, Marmelstein & Kubovcik

[57] ABSTRACT

A head of a golf club comprises a head body having a face portion, for hitting a golf ball, and a back portion. A surface structure for producing a turbulent boundary layer in the air on the outer surface of the head body is provided on the outer surface substantially throughout a region from the periphery of the face portion of the head body to the back portion of the head body. The surface structure may include a plurality of fine grooves or a plurality of fine fibers erected on the outer surface of the head body.

4 Claims, 4 Drawing Sheets

GOLF CLUB HEAD

BACKGROUND OF THE INVENTION

1. Field of the Invention

The present invention relates to a head of a golf club and, more particularly, to an improvement in aerodynamic characteristics of the surface of a head of a golf club.

2. Description of the Related Art

Generally, the kinetic speed of a head of a golf club during the swing thereof increases during a down-swing of the club and is highest at the moment of impact with a golf ball. The maximum head speed attained by the average golfer during such a swing is usually in the range of from 30 to 50 m/sec, but to increase the fly distance of a golf ball, it is necessary to increase this maximum head speed. However, an aerodynamic drag, large enough to ensure that it cannot be neglected, is imposed on the head during the swing movement, and thus, to increase the maximum head speed and to stabilize the swing movement of the head, it is necessary to improve the aerodynamic characteristics of the surface of the head of the golf club.

When a conventional head of a golf club is swung, a laminar air flow boundary layer is produced on the outer surface of the head, and at the rear end of the laminar air flow boundary layer, the air stream is exfoliated from the outer surface of the head and a subatmospheric pressure region is formed behind the head. The air stream exfoliated from surface of the head is changed directly to a turbulent flow or swirling stream by the subatmospheric pressure.

In this air stream condition, air in front of the head is compressed and the air pressure increased, but behind the air stream-exfoliating point, the air pressure is reduced. Accordingly, an aerodynamic drag due to the pressure difference in front of and behind the head (hereinafter referred to as "pressure drag") is imposed on the head during the swing. It is known that such a pressure drag reduces the head speed during the swing and has an adverse affect on the stability of the movement of the head during the swing.

When a turbulent boundary layer in the air, i.e., an intermediate boundary layer at the point of transition from a laminar flow to a turbulent flow, is generated on the surface of the head, the air stream is not easily exfoliated from the head surface and the exfoliating point of the air stream is shifted to the rear part of the head. Accordingly, the subatmospheric pressure generated behind the exfoliating point of the air stream is reduced, resulting in reduction of the pressure drag acting on the head. When the relationship between the head speed during the swing and the pressure drag acting on the head is examined, it is seen that an increase of the head speed, causes an increase of the pressure drag, but at the point when the air stream boundary layer on the head surface changes from the laminar flow boundary layer to the turbulent boundary layer, the pressure drag is abruptly reduced and then, with the increase of the head speed, the pressure drag is also increased. The kinetic speed of a body at which the pressure drag is abruptly reduced is generally called the "critical speed", and this term is accordingly adopted in this description.

To increase the maximum head speed during the swing, preferably a turbulent boundary layer is formed on the head surface as soon as possible before the head speed reaches a highest level, thus reducing the pressure drag, and the degree of reduction of the pressure drag is increased. However, in case of a conventional head, the critical speed is higher than the maximum head speed attainable by an average player, and therefore, a large pressure drag is imposed on the head during the swing.

In a club head disclosed in Japanese Examined Patent Publication No. 53-31417, which corresponds to U.S. patent application No. 387,760, a groove, called a "trip step", is formed on the top edge of the face portion of a head body to produce a turbulent boundary layer in the air on the head surface. In a club head having such a trip step, a turbulent boundary layer can be generated in the stage where the head speed is relatively low, but the region where the turbulent boundary layer is formed is relatively narrow and, therefore, exfoliation of the air stream occurs at a position relatively close to the face portion of the head body. Accordingly, this club head is defective in that the degree of reduction of the pressure drag at the critical speed is small and the increase of the pressure drag with the subsequent increase of the head speed is large.

SUMMARY OF THE INVENTION

According to the present invention, there is provided a head of a golf club comprising: a head body having a face portion, for hitting a golf ball, and a back portion; and means arranged on an outer surface of the head body substantially throughout a region from the periphery of the face portion of the head body to the back portion of the head body, to produce a turbulent boundary layer in the air on the outer surface of the head body during a swing of a golf club.

In the golf club head according to the present invention, a turbulent boundary layer is produced over a broad region of the head surface, at the stage where the head speed is relatively low, and the exfoliating point of the air stream is shifted to a rear part of the head. Accordingly, the degree of the pressure drag at the critical speed is increased and the increase of the pressure drag with a subsequent increase of the head speed is reduced, with the result that the swing can be made with a small pressure drag. Therefore, the head speed during the swing is increased and the swing orbit of the head is stabilized, and the fly distance and directionality of a ball is improved.

The means for producing a turbulent boundary layer in the air on the outer surface of the head body may comprise a plurality of fine grooves formed on the outer surface of the head body or a plurality of line fibers erected on the outer surface of the head body.

The foregoing and other objects and advantages of the present invention will be better understood from the following description with reference to the preferred embodiments illustrated in the drawings.

DESCRIPTION OF THE PREFERRED EMBODIMENTS

Figure 1:
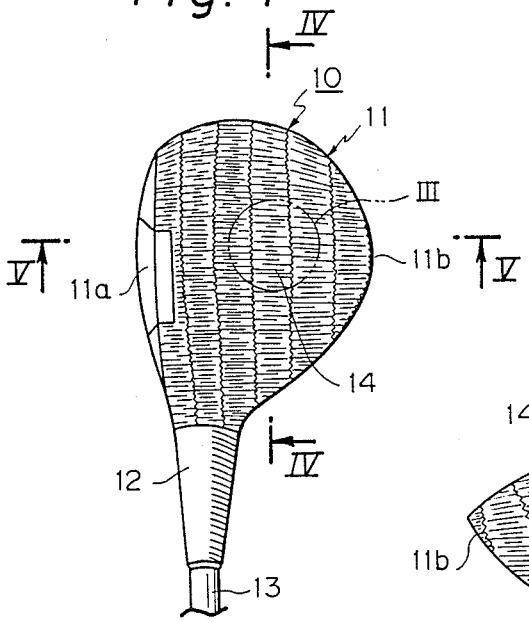
FIG. 1 is a plane view of a club head showing a first embodiment of the present invention applied to a so-called wood club.
Figure 2:
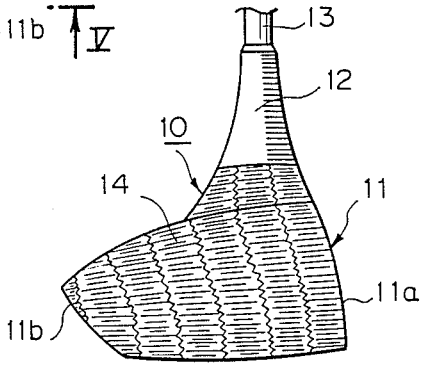
FIG. 2 is a side view of the head shown in FIG. 1.
Figure 3:
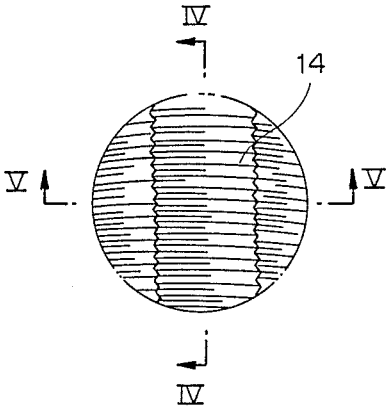
FIG. 3 is an enlarged view showing a portion III of the outer surface of the head shown in FIG. 1.
Figure 4:
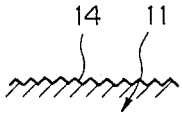
FIG. 4 is an enlarged cross-sectional view of the head shown in FIG. 1 taken along the line IV—IV in FIG. 3.
Figure 5:
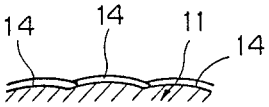
FIG. 5 is an enlarged cross-sectional view of the head shown in FIG. 1 taken along the line V—V in FIG. 3.

FIGS. 1 to 5 illustrate a first embodiment of the present invention, which is applied to a so-called wood club. Referring to FIGS. 1 and 2, a club head 10 has a head body 11 and a neck or hosel portion 12 integrated with the head body 11. A club shaft 13 is attached to the neck or hosel portion 12. The head body 11 has a face portion 11*a* for hitting a golf ball and a back portion 11*b*. A plurality of fine or shallow grooves 14 for producing a turbulent boundary layer in the air on the outer surface of the head body 11 are formed in a so-called fishskin pattern substantially over the entire outer surface of the head body 11 from the periphery of the face portion 11*a* of the head body 11 to the back portion 11*b* of the head body 11. As apparent from FIGS. 1 to 3, the grooves 14 are arranged regularly in rows extending a first direction substantially parallel to the face portion 11*a*, and the grooves are elongated in a second direction perpendicular to the first direction. Each groove 14 has a V-shaped cross section, as shown in FIG. 4, and is given a convex curve from the center to each end thereof, in the longitudinal direction, as shown in FIG. 5.

Figure 6:
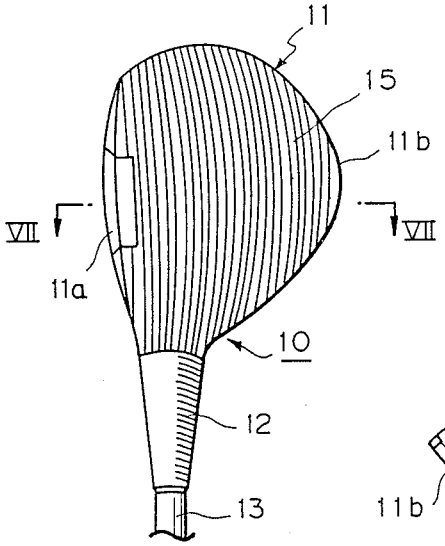
FIG. 6 is a plane view of a club head showing a second embodiment of the present invention.
Figure 7:
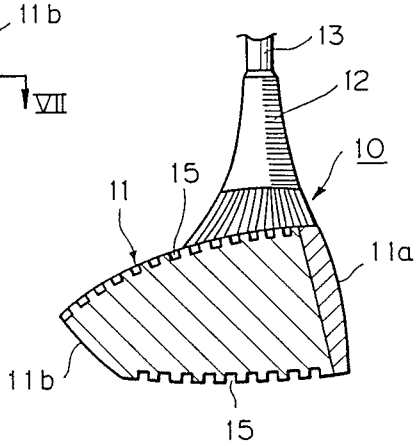
FIG. 7 is a cross-sectional view of the head shown in FIG. 6 taken along the line VII—VII in FIG. 6.

FIGS. 6 and 7 illustrate a second embodiment of the present invention. In these Figures, the same constituent elements as in the first embodiment are represented by the same reference numerals. In the second embodiment, a plurality of fine grooves 15 for producing a turbulent boundary layer in the air on the outer surface of the head body 11 are formed substantially on the entire outer surface of the head body 11 from the periphery of the face portion 11*a* of the head body 11 to the back portion 11*b* of the head body 11. Each of the grooves 15 extends in a first direction parallel to the face portion 11*a*, and is arranged in a second direction perpendicular to the first direction.

Figure 8:
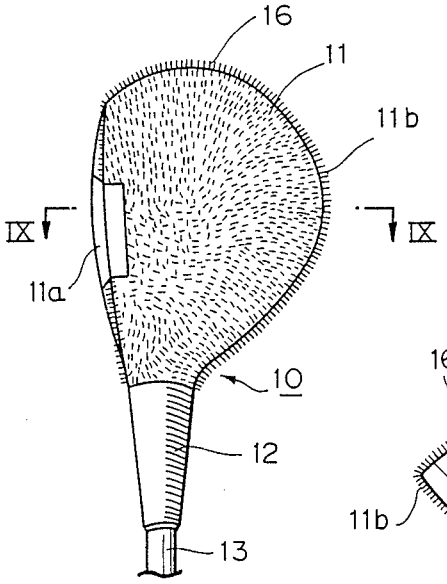
FIG. 8 is a plane view of a club head showing a third embodiment of the present invention.
Figure 9:
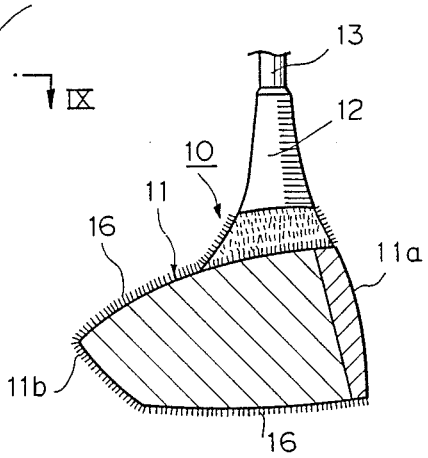
FIG. 9 is a cross-sectional view of the head shown in FIG. 8 taken along the line VII—VII in FIG. 8.

FIGS. 8 and 9 illustrate a third embodiment of the present invention. In these Figures, the same constituent elements as in the first embodiment are represented by the same reference numerals. In the third embodiment, a plurality of line fibers 16 for producing a turbulent boundary layer in the air on the outer surface of the head body 11 are provided substantially over the entire outer surface of the head body 11 from the periphery of the face portion 11*a* of the head body 11 to the back portion 11*b* of the head body 11. The fine fibers 16 are erected on and secured to the outer surface of the head body 11 by an implanting treatment, wherein a coating of an adhesive is first applied on the outer surface of the head body 11, fine fibers of nylon, polyethylene terephthalate or rayon are then spinkled on the surface of the applied adhesive, and the fine fibers are then brought to an erect position, i.e., substantially perpendicular to the surface of the head body 11, by an electrostatic field, and secured in this state by curing the adhesive.

Figure 10:
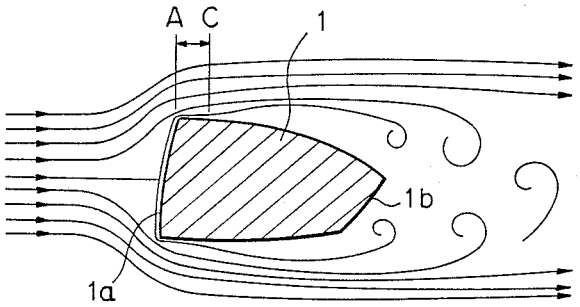
Fig. 10 PRIOR ART
FIG. 10 is a cross-sectional side view schematically illustrating the state of air streams produced around the conventional head during the swing.

FIG. 10 is a cross-sectional side view schematically showing the state of air streams generated around a wood type head of a golf club when an swing is made with a conventional golf club. Referring to FIG. 10, the conventional head 1 has a face portion 1*a* and a back portion 1*b*. A laminar air flow boundary layer is produced on the outer surface of the head 1 within the region between points A and C during a swing, and at the rear end (point C) of the laminar air flow boundary layer, the air stream is exfoliated from the outer surface of the head 1 and a subatmospheric pressure region is formed behind the head 1. The air stream exfoliated from surface of the head is changed directly to a turbulent flow or swirling stream by the subatmospheric pressure.

In this air stream condition, air in the front of the head 1 is compressed and the air pressure increased, but behind the air stream-exfoliating point (C), the air pressure is reduced. Accordingly, a pressure drag due to the pressure different in front of and behind the head is imposed on the head 1 during the swing. It is known that such a pressure reduces the head speed during the swing and has an adverse affect on the stability of the movement of the head during the swing.

Figure 11:
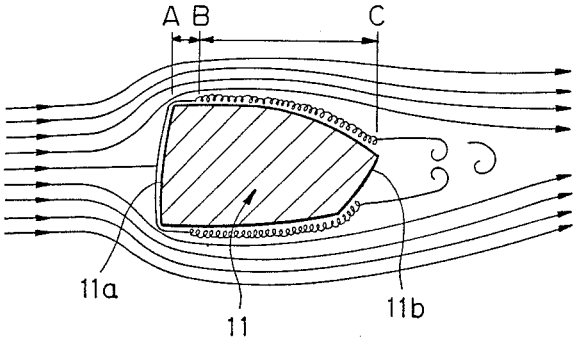
FIG. 11 is a cross-sectional side view schematically illustrating the state of air streams produced around the head according to the present invention during the swing.

FIG. 11 schematically illustrates the state of air streams around the above-mentioned golf club head according to the present invention during the swing. Referring to FIG. 11, a laminar air flow boundary layer is formed along the outer surface of the head body 11 within the region between points A and B, a turbulent boundary layer is produced along the outer surface of the head body 11 within the region between points B and C, and at point C, the air streams are exfoliated from the outer surface of the head body 11 and a swirling stream is produced behind point C. As apparent from FIG. 11, in the head according to the present invention, a turbulent boundary layer is produced on the head surface over a broad region, and therefore, the exfoliating point C of the air stream is brought close to the rear end of the head body 11 and the subatmospheric pressure produced behind the head body 11 can be reduced.

Figure 12:
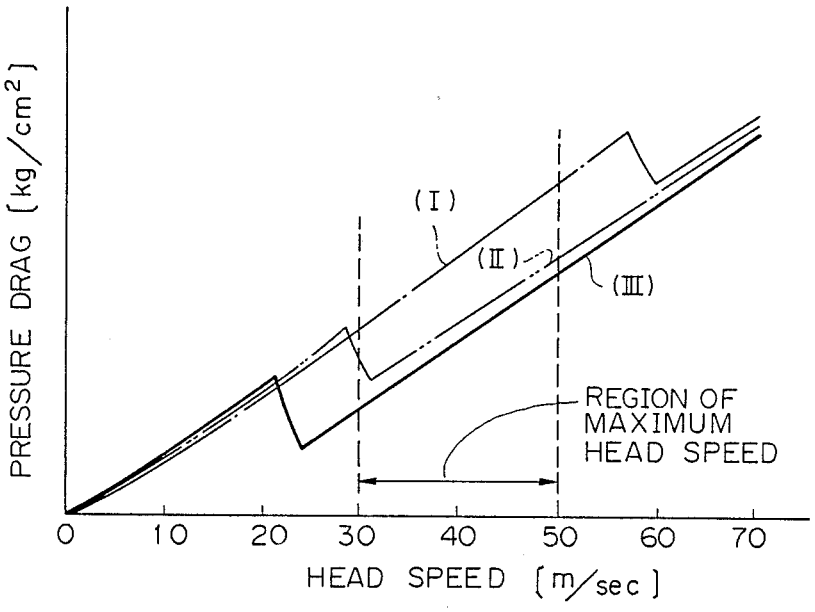
FIG. 12 is a graph illustrating the relationship between the head speed and the pressure drag acting on the head during the swing.

FIG. 12 schematically illustrates the relationship between the head speed and the pressure drag in the conventional club heads and in the head according to the present invention. In the case of the conventional ordinary club head, as indicated by a one-dot line denoted by a reference character (I), the critical speed is about 60 m/sec and in the case of another conventional club head having a trip step on the top edge of the face portion, as indicated by a two-dot line denoted by a reference character (II), the critical speed is about 30 m/sec. In contrast, in the head according to the present invention, as indicated by a solid line denoted by a reference character (III), the critical speed is about 25 m/sec. When an average player swings a golf club, the maximum head speed is about 30 to 50 m/sec. Accordingly, in case of the head according to the present invention, the swing can be made in the region where the pressure drag is reduced. When the head according to the present invention is compared with the conventional head having a trip step on the top edge of the face portion, it is seen that the critical speed is lower in the head of the present invention and the degree of reduction of the pressure drag at the critical speed is smaller than in the conventional head. Furthermore, in the head of the present invention, since the pressure drag is reduced in the region where the speed is higher than the critical speed, the swing can be made in a condition where the pressure drag is smaller than in the conventional head having a trip step, and the fly distance and directionality of flight of a golf ball hit by the head are improved.

Although particular embodiments of the present invention illustrated in the drawings have been described, it will be understood, of course, that the present invention is not limited thereto, since modifications can be easily made by those skilled in the art in the light of the foregoing teaching. For example, the means for producing an air-turbulent boundary layer on the outer surface of the head body may be provided on the outer surface of the head body only on the region except the face portion and the sole side of the head body. Moreover, the present invention may be similarly applied to a so-called iron type club head.

I claim:

1. A head of a golf club comprising:

a head body having a face portion for hitting a golf ball; and a remaining surface portion other than said face portion, said remaining surface portion being provided with a plurality of elongated shallow grooves grooves, each of said grooves having a longitudinal length much shorter than a width of said head along the direction perpendicular to said face portion and each being outwardly curved along the axis thereof, said grooves being perpendicular to said face portion and in rows parallel to said face portion such that adjacent are directly connected each other.

2. A head according to claim 1, wherein said remaining surface portion comprises a plurality of grooves arranged substantially throughout a region from the periphery of said face portion to the back portion of said head body.

3. A head according to claim 2, wherein each of said grooves has a V-shaped cross section.

4. A head according to claim 2, wherein each of said grooves has a convex curve from the center thereof to both ends thereof.

* * * * *